US008401201B2

(12) United States Patent
Tanaka

(10) Patent No.: US 8,401,201 B2
(45) Date of Patent: Mar. 19, 2013

(54) SOUND PROCESSING APPARATUS AND METHOD

(75) Inventor: Atsushi Tanaka, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 293 days.

(21) Appl. No.: 12/962,469

(22) Filed: Dec. 7, 2010

(65) Prior Publication Data

US 2011/0150230 A1 Jun. 23, 2011

(30) Foreign Application Priority Data

Dec. 17, 2009 (JP) ..... 2009-286961

(51) Int. Cl.
*H04R 29/00* (2006.01)

(52) U.S. Cl. ..... 381/58; 381/66; 381/93; 381/59; 381/61; 381/98; 381/101; 381/103; 381/97; 379/406.01; 379/406.08; 7/164; 700/94

(58) Field of Classification Search ..... 381/66, 381/93, 58, 59, 61, 98, 101, 103, 97; 379/406.01, 379/406.08; 7/164; 700/94
See application file for complete search history.

(56) References Cited

U.S. PATENT DOCUMENTS

| | | | | |
|---|---|---|---|---|
| 4,279,005 | A * | 7/1981 | Kitamura et al. | 360/66 |
| 5,714,698 | A | 2/1998 | Tokioka et al. | 73/865.4 |
| 6,415,240 | B1 | 7/2002 | Kobayashi et al. | 702/150 |
| 7,075,514 | B2 | 7/2006 | Tanaka | 345/157 |
| 7,664,276 | B2 * | 2/2010 | McKee Cooper | 381/103 |
| 7,747,027 | B2 * | 6/2010 | Asada | 381/101 |
| 2005/0152557 | A1 * | 7/2005 | Sasaki et al. | 381/58 |
| 2005/0265560 | A1 * | 12/2005 | Haulick et al. | 381/58 |
| 2007/0133823 | A1 * | 6/2007 | Nakano | 381/103 |
| 2007/0230556 | A1 * | 10/2007 | Nakano | 375/232 |
| 2009/0274307 | A1 * | 11/2009 | Yoshino et al. | 381/1 |

FOREIGN PATENT DOCUMENTS

| | | | |
|---|---|---|---|
| JP | 5-83786 | | 4/1993 |
| JP | 08184488 | A * | 7/1996 |
| JP | 2004166106 | A * | 6/2004 |
| JP | 2006319823 | A * | 11/2006 |
| WO | WO 2008004541 | A1 * | 1/2008 |

OTHER PUBLICATIONS

U.S. Appl. No. 12/957,182, filed Nov. 30, 2010 by Atsushi Tanaka.

* cited by examiner

*Primary Examiner* — Davetta W Goins
*Assistant Examiner* — Kuassi Ganmavo
(74) *Attorney, Agent, or Firm* — Fitzpatrick, Cella, Harper & Scinto

(57) ABSTRACT

A sound processing apparatus according to the present invention acquires a test signal for measuring a standing wave state emitted in a listening room, and determines a peak position or a dip position due to a standing wave based on frequency characteristics of the test signal. Next, the sound processing apparatus emits a burst signal corresponding to the frequency of the peak position or the dip position, and acquires this signal. The sound processing apparatus calculates an increment ΔP of the acquired signal, which indicates an amount of increase of a peak in the trailing edge portion corresponding to the end position of the burst signal relative to a peak in the portion corresponding to the stationary portion of the burst signal, and attenuates the frequency of the above peak position or dip position of a sound signal to be output by an attenuation depending on ΔP.

7 Claims, 10 Drawing Sheets

SOUND PROCESSING APPARATUS AND METHOD

BACKGROUND OF THE INVENTION

1. Field of the Invention

The present invention relates to sound field correction technique for correcting the influence on frequency characteristics caused by a standing wave in a room.

2. Description of the Related Art

In the case where sound is emitted from a sound source such as a loudspeaker in a room of a house or the like, since there is reflected sound from surfaces such as a wall, a ceiling, and a floor of the room in addition to direct sound that arrives at spots in the room over the shortest distance, these sound waves become superimposed on each other. At this time, for example, a standing wave is generated, and bass resonance called booming occurs between the surfaces facing each other in parallel in the case of a frequency at which the distance between such surfaces is an integral multiple of the half-wave length of the sound wave.

In such a case, booming is suppressed with a parametric equalizer, or acoustic characteristics are measured in advance at a listening position using a microphone, and correction is performed based on the inverse characteristics thereof. Furthermore, in addition to such technology, technology utilizing direction information of reflected sound is also disclosed (for example, see Japanese Patent Laid-Open No. 5-83786).

If frequency characteristics of a listening room or the like are measured, the characteristics as shown in FIG. 2 can be obtained, for example. A standing wave is generated in a peak portion in which the sound pressure level is increasing and in a dip portion in which the sound pressure level is decreasing. The standing wave portions have a frequency at which the sound output from a loudspeaker or the like resonates with respect to the size of the room, and have not only a greater level of fluctuation, but also a greater change in a time direction relative to other frequency portions.

The influence due to a standing wave will now be described with reference to FIG. 3. In FIG. 3, a signal 33 is a signal having a frequency of a dip portion. A signal 32 is a signal having a frequency of a flat portion in terms of frequency characteristics, and a signal 31 is a signal when the signal 32 is emitted in bursts. The sound pressure level of the signal 32 corresponding to the flat portion steeply drops following the fall of the burst-like signal 31.

The signal 33 corresponding to the dip portion starts rising in a normal manner in the leading edge portion thereof in the state where there is no reflected wave. However, since the signal 33 corresponding to the dip portion has a frequency at which a standing wave is generated, upon the start of interference with a reflected wave, the level thereof becomes lower during the occurrence of the burst signal, due to interference of a direct wave and a reflected wave. Furthermore, since the signal 33 is in the resonance state at a standing wave frequency, although the original burst signal has fallen, the signal is observed having a higher level than that while sound is produced. This is because the component of the direct wave is lost along with the end of the burst signal, and thus only the component of the reflected wave that has increased due to resonance remains, which allows a signal having a higher level than that during the sound production period to remain for a long time in spite of the end of sound wave output. For this reason, the signal component of the dip portion has a lower level while sound is originally produced, and has a higher volume at the time when sound should not be produced, which causes a problem concerning auditory sensation.

Further, a frequency of the standing wave peak portion also has a problem that loud reverberation remains for a long time, for instance. In the case of general booming correction, a technique is employed in which a frequency component corresponding to the peak portion of a standing wave is always attenuated by a fixed amount using a parametric equalizer or the like. However, if this technique is applied to the dip portion, negative effects are caused, one example of which is that a portion where the original sound that has already been decreased due to interference is further attenuated, and thus the sound of that portion can hardly be heard.

SUMMARY OF THE INVENTION

The present invention reduces the influence of reverberation that occurs after the fall of a signal having a frequency component that causes a standing wave to occur, which is the cause of a problem concerning auditory sensation.

According to one aspect of the present invention, a sound processing apparatus for adjusting a sound signal to be output based on acoustic characteristics of a listening room is provided. The apparatus comprises a first acquisition unit configured to emit a test signal for measuring a standing wave state in the listening room from a loudspeaker, and acquire the test signal that has been emitted using a microphone, a determination unit configured to determine a peak position or a dip position due to a standing wave based on frequency characteristics of the signal acquired by the first acquisition unit, a second acquisition unit configured to emit a burst signal corresponding to a frequency of the peak position or the dip position from the loudspeaker in the listening room, and acquire the burst signal that has been emitted using the microphone, a calculation unit configured to calculate an increment $\Delta P$ of the signal acquired by the second acquisition unit, the $\Delta P$ indicating an amount of increase of a peak in a trailing edge portion corresponding to an end position of the burst signal relative to a peak in a portion corresponding to a stationary portion of the burst signal, and a filter unit configured to attenuate a frequency component of the peak position or the dip position of the sound signal to be output by an attenuation depending on the $\Delta P$.

Further features of the present invention will become apparent from the following description of exemplary embodiments with reference to the attached drawings.

DESCRIPTION OF THE EMBODIMENTS

Hereinafter, a preferred embodiment of the present invention is described in detail with reference to the drawings.

Figure 1:
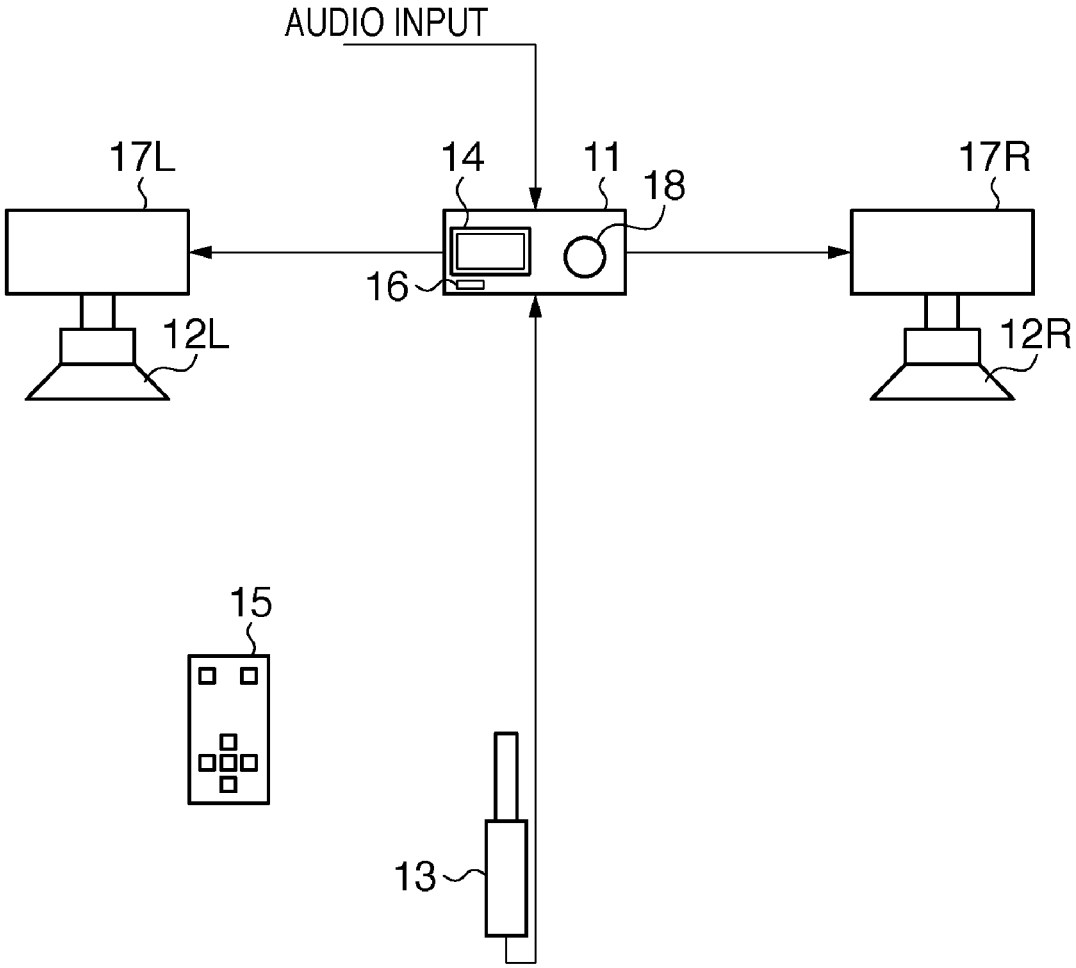
FIG. 1 is a diagram showing the configuration of a sound system according to an embodiment.
Figure 2:
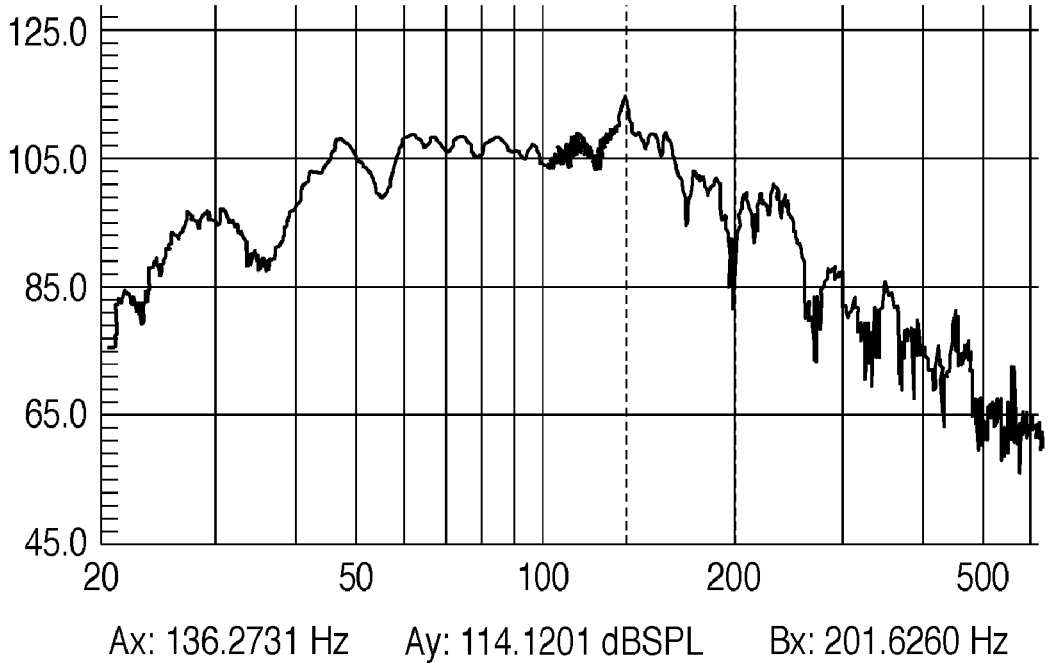
FIG. 2 is a diagram showing an example of frequency characteristics in a listening room.

FIG. 1 is a diagram showing the configuration of a sound system according to an embodiment of the present invention. This sound system can adjust a sound signal to be output based on the acoustic characteristics of a listening room, which is a reproduced sound field, using the configuration and processing that will be described below. A sound processing apparatus 11 is provided with a display unit 14, a volume control 18, a remote controller light receiving unit 16, and the like. Audio signals are transmitted to loudspeakers 12L and 12R from the sound processing apparatus 11. Both of the loudspeakers 12L and 12R are active speakers, and have power amplifiers 17L and 17R, respectively. This configuration is an example, and a configuration may be adopted in which the loudspeakers are not active speakers, and power amplifiers are provided between the sound processing apparatus and the loudspeakers.

Reference numeral 13 denotes a microphone, which is used to acquire test signals and the like transmitted to the loudspeakers 12L and 12R from the sound processing apparatus 11. Reference numeral 15 denotes a remote controller that controls the sound processing apparatus 11, and is ordinarily for selecting an audio device (such as a CD player or a DVD player) (not shown) connected to the sound processing apparatus 11 and for performing volume control.

Figure 4:
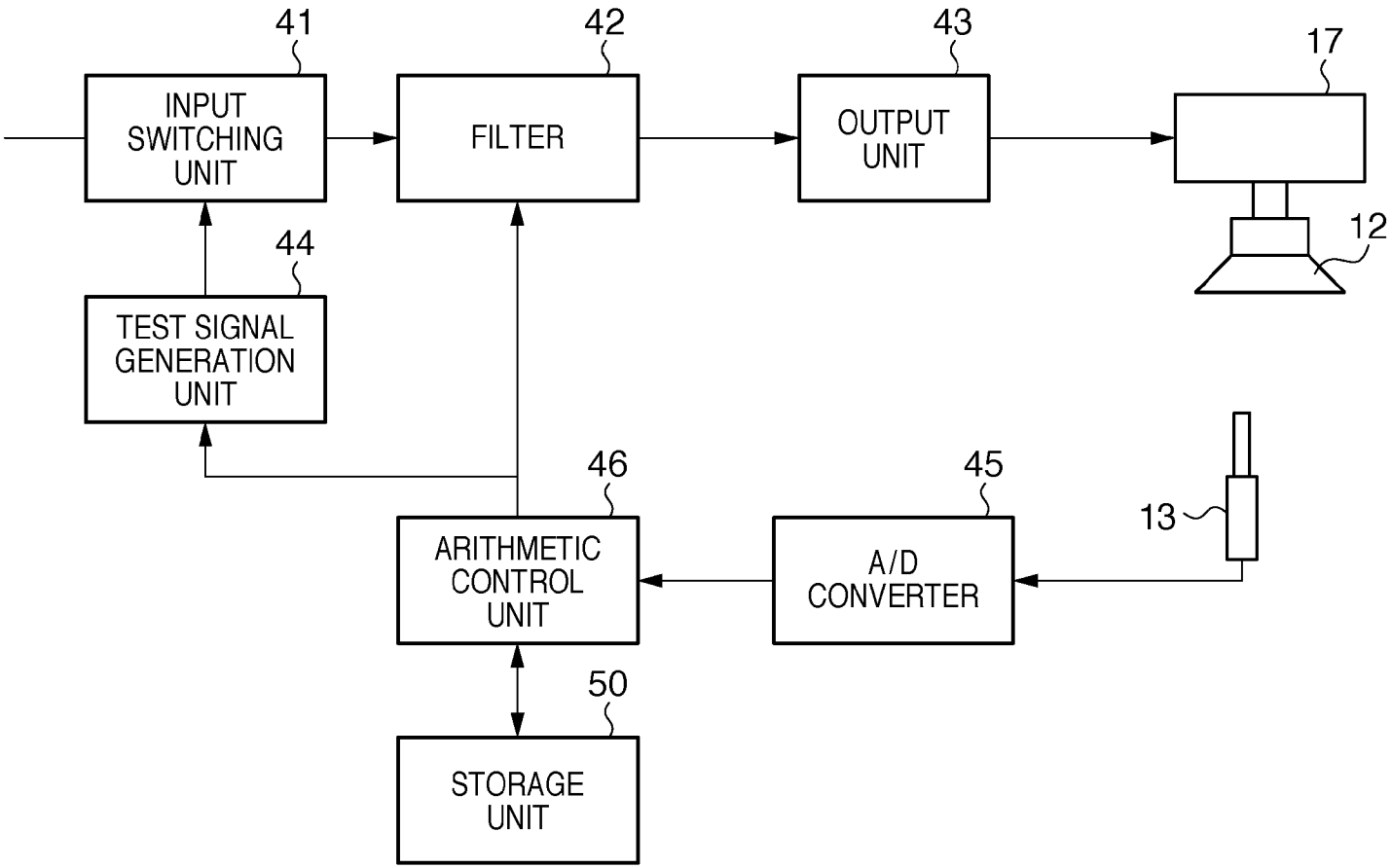
FIG. 4 is a block diagram showing an example of a configuration of a sound processing apparatus according to the embodiment.

FIG. 4 is a diagram showing the configuration of the sound processing apparatus 11. During the ordinary operation, music information from an external sound device connected to an input switching unit 41 is transmitted to an output unit 43 via a filter 42. The output unit 43 outputs analog music information using a D/A converter (not shown) if it is an apparatus that has line out. On the other hand, if the output unit 43 performs digital output, an output signal is converted into, for example, a digital IF signal such as an SPDIF signal, and the resultant music information is output to the loudspeakers 12L and 12R.

During an operation for deciding a correction coefficient, the input switching unit 41 is connected to a test signal generation unit 44 in response to an instruction from an arithmetic control unit 46. The test signal generation unit 44 can output a sweep signal whose frequency continuously changes from a low frequency to a high frequency, white noise, and the like. Alternatively, the test signal generation unit 44 can also output a signal using an MLS (maximum length sequence) signal using an M-sequence signal, which is a type of a pseudo-random signal. A method for generating this signal is simple, and at the same time, it is possible to obtain an impulse response at high speed by using a technique such as Hadamard transform, and further the signal has advantages such as that calculation can be performed in a short time when measuring characteristics in a user's listening room or the like.

The microphone 13 can acquire test signals generated from the loudspeakers 12. An electrical signal output from the microphone 13 is converted into digital data by an A/D converter 45 and transmitted to the arithmetic control unit 46, and then, for example, can be recorded in a storage unit 50 and also analyzed by the arithmetic control unit 46 according to a program.

Figure 5:
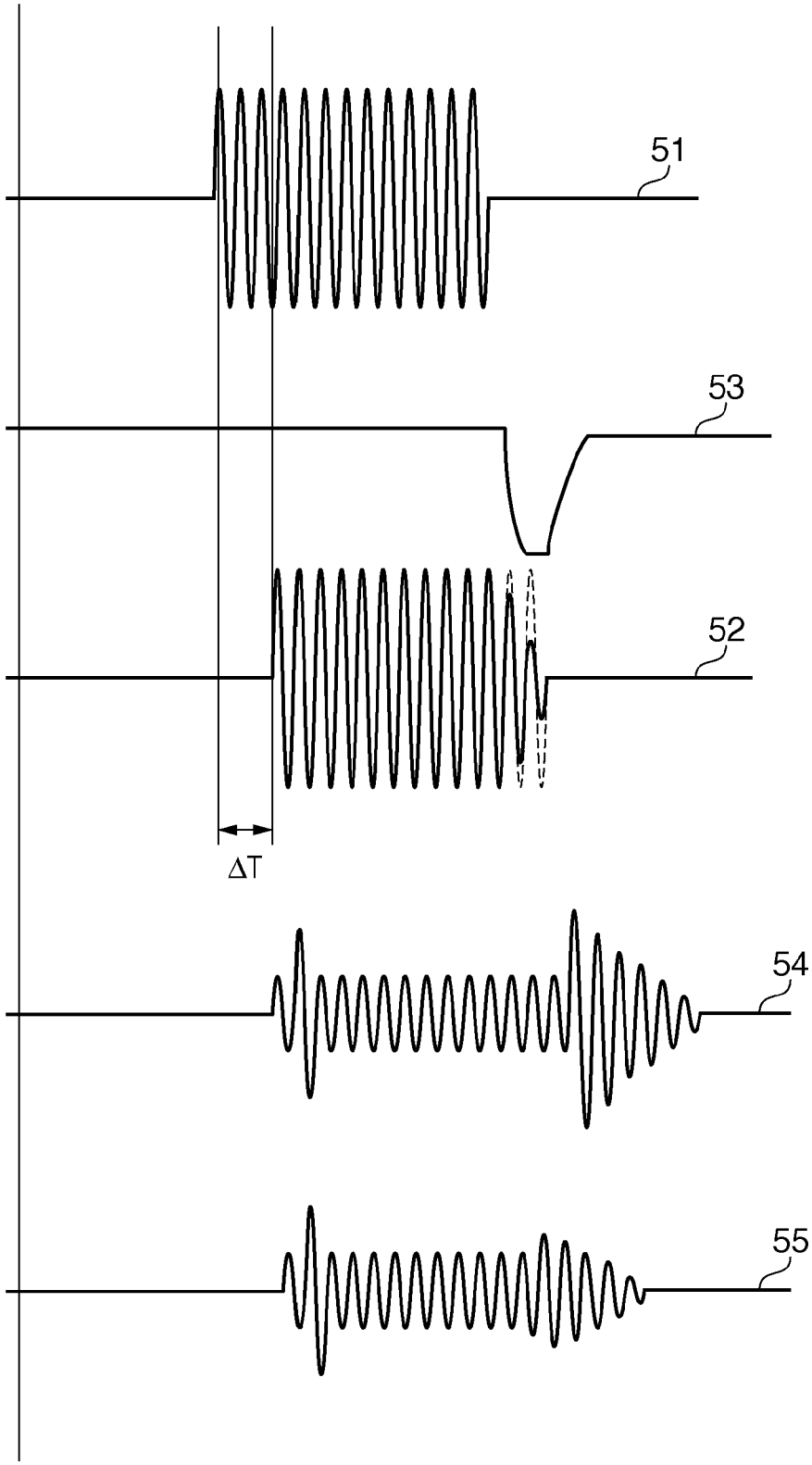
FIG. 5 is a timing diagram related to application of an attenuation control signal.

In the filter 42, processing as shown in FIG. 5 is performed. Now, for description, consider the case where only a signal 51 having a frequency at which dipping has occurred due to a standing wave in terms of frequency characteristics is input. Due to the resonance characteristics of the room, a signal observed as a sound wave with respect to the input signal 51 has a waveform in which the sound pressure rises after signal output stops as shown by a signal 54. The filter 42 is configured so as to reduce the gain in the trailing edge portion of the input signal 51, and output the resultant signal so as to prevent the rise in sound pressure after signal output stops.

Specifically, an attenuation control signal 53 is generated from the input signal 51 by a later-described differential process or the like. Since the attenuation control signal 53 is synchronized with trailing edge characteristics of the input signal, the output signal is delayed by a fixed time $\Delta T$ to attenuate only the trailing edge portion of the signal, and the attenuation of a notch filter for this frequency is controlled using this attenuation control signal. Accordingly, the dashed line portion of a signal 52 can be attenuated as shown by the solid line portion.

By reducing the gain of the trailing edge portion of the output signal in the above manner, a conventional output signal 54 can be made into a signal 55 in which the rise in sound pressure after output stops is suppressed. Accordingly, it is possible to have an effect only on a reverberation portion having a problem concerning auditory sensation by attenuating only the trailing edge portion of the output signal, without decreasing the sound pressure of the leading edge portion of the signal or a continuous sound portion thereof in which the sound pressure has dropped due to interference.

Figure 6:
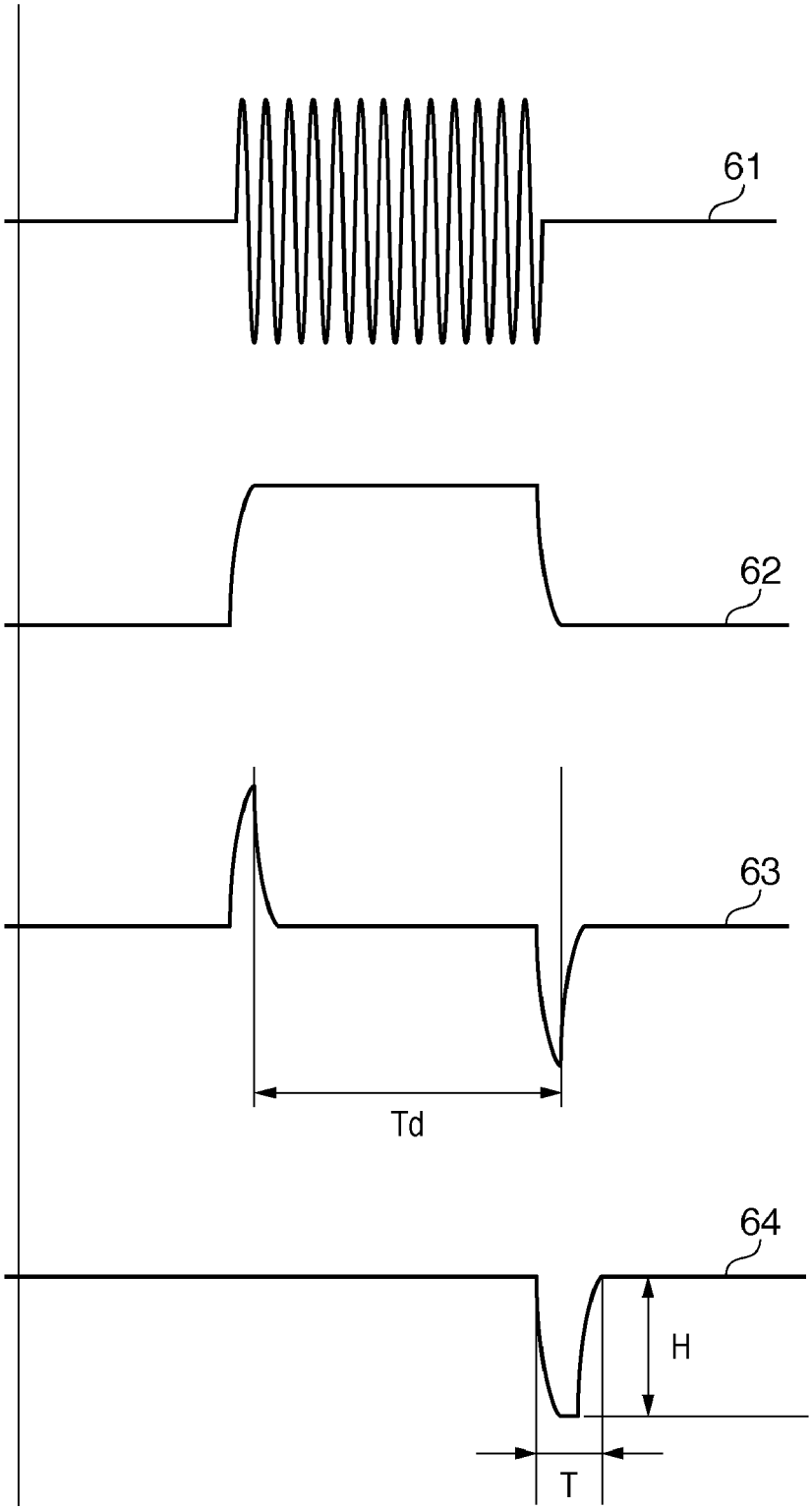
FIG. 6 is a diagram illustrating generation of the attenuation control signal.

FIG. 6 is a diagram schematically showing generation of the attenuation control signal. A differential process is performed on an input signal 61 in order to extract the trailing edge timing thereof. For that purpose, an envelope signal 62 of the input signal 61 is generated first. A differential process is performed on the generated envelope signal, and a differential signal 63 is obtained. At a position in synchronization with the signal on the negative side of this differential signal in relation to the trailing edge, a pulse signal 64 having a predetermined time width T and a predetermined amplitude H is generated with respect to the reverberation time of the listening room, for example, and this generated signal is used as the attenuation control signal 53.

Figure 7:
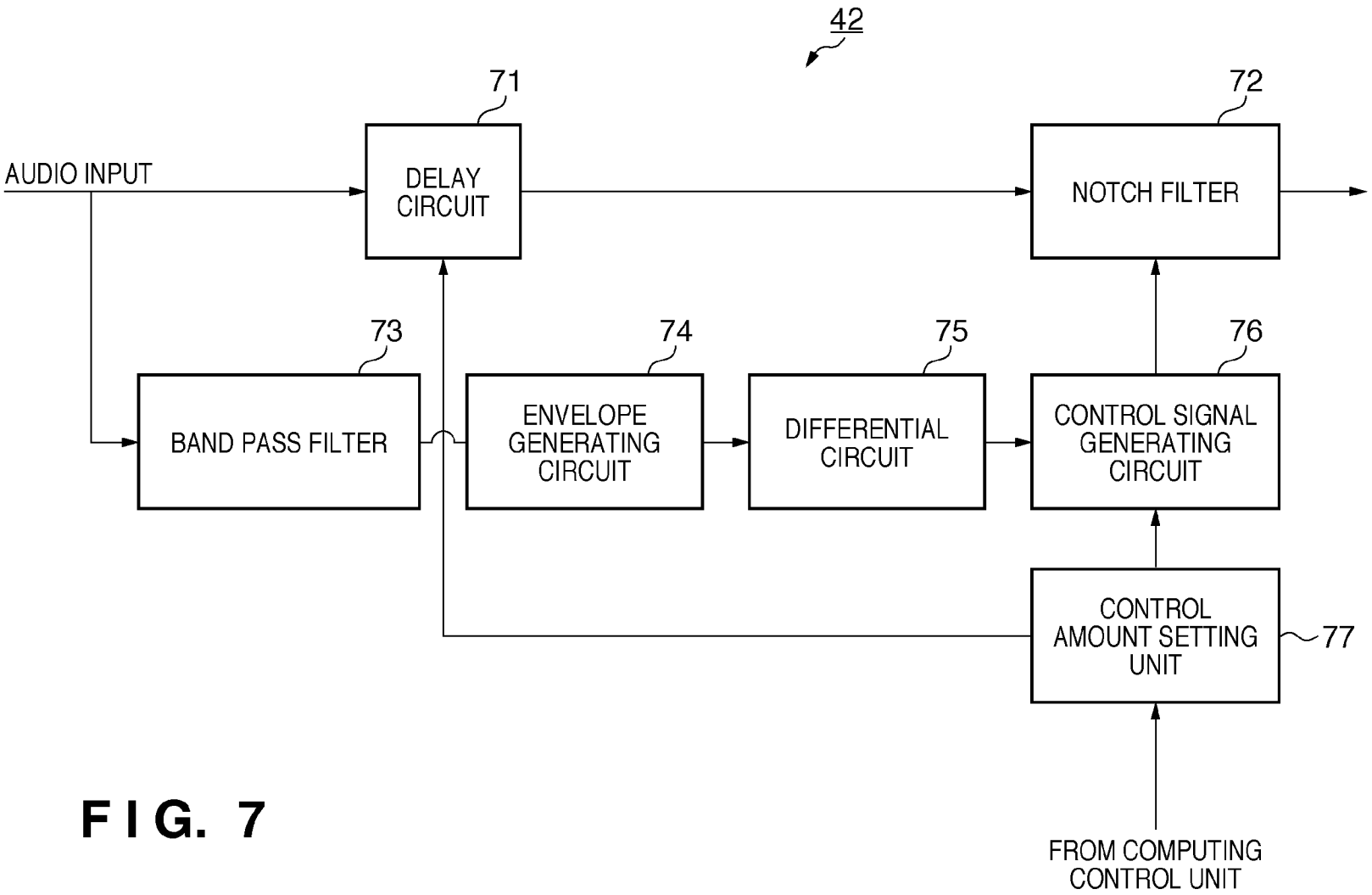
FIG. 7 is a block diagram showing an example of a configuration of a filter according to the embodiment.

These processes can be realized using the block configuration of the filter 42 shown in FIG. 7. A sound signal (input signal) to be output is input to a delay circuit 71 for making the sound signal an output signal, and a band pass filter 73 for discriminating a frequency of a peak position or a dip position. A signal having a determined frequency as a result of the discrimination by the band pass filter 73 is input to a differential circuit 75 through an envelope generating circuit 74. A signal in synchronization with the trailing edge timing of the signal is output from the differential circuit 75, and an attenuation control signal having the pulse width and the gain that have been set by a control amount setting unit 77 is generated with respect to this output signal by a control signal generating circuit 76.

The gain of a notch filter 72 is controlled by the generated attenuation control signal, thus controlling the gain of the trailing edge portion of the input signal that has been delayed by the delay circuit 71 by a fixed time, which has been previously set by the control amount setting unit 77. For the delay time, a delay time greater than or equal to the pulse width set by the control amount setting unit 77 is necessary.

Figure 8:
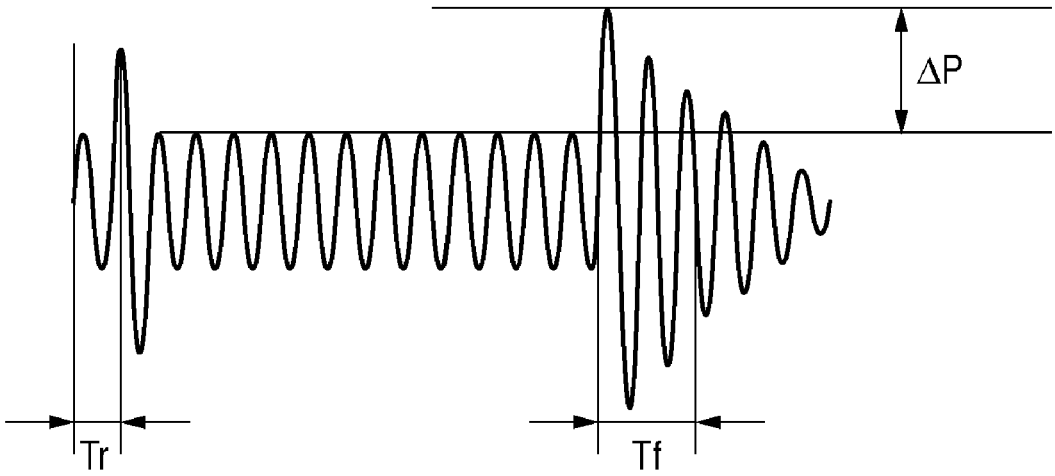
FIG. 8 is a diagram illustrating a burst detection wave.

The pulse width and the amplitude of the attenuation control signal may be decided based on the reverberation characteristics of the listening room. For example, consider the case where a signal shown in FIG. 8 is obtained as a signal having a frequency corresponding to the dip position, with respect to a burst signal. In this case, in the trailing edge portion following a stationary portion in which the level is lower due to resonance, the signal peak once increases by ΔP, and thereafter the level falls. In view of this, it is sufficient to measure the time period from when the signal peak has increased by ΔP in the trailing edge portion until when the signal peak has decreased so as to have a value equal to that of the peak in the stationary portion, and decide the pulse width and height in correspondence with that time period based on a table prepared in advance. Alternatively, it is sufficient to measure ΔP, and decide the pulse width or the pulse height such that the value of ΔP becomes less than or equal to the value set in advance, that is, for example, the value of ΔP becomes the same as that in the portion in which the level is low. Thus, the pulse width and the amplitude of the attenuation control signal can be set depending on ΔP.

Figure 9:
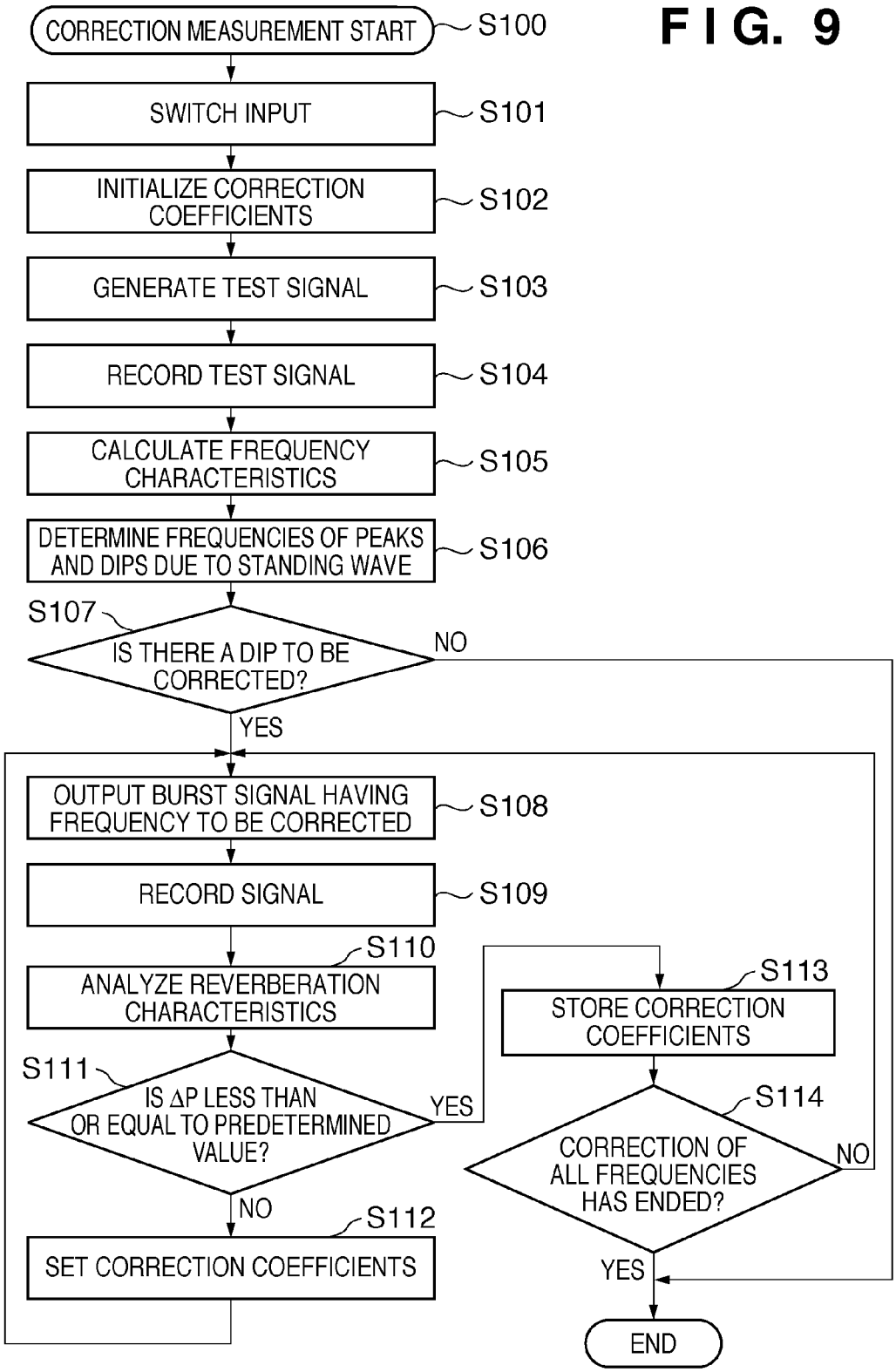
FIG. 9 is a flow chart showing correction coefficient deciding processing according to the embodiment.

FIG. 9 is a flowchart showing correction coefficient deciding processing according to the embodiment. This processing starts (S100) by being instructed to set a correction coefficient deciding mode as an operational mode via the remote controller or the like. Before starting operation, a message may be displayed to the user on the display unit 14 in order to prompt the user to place the microphone 13 at a listening point, which is a place where the user usually listens to music, and connect it to the A/D converter 45. When the microphone 13 is connected, an instruction is given to the input switching unit 41 so as to receive an input of a signal from the test signal generation unit 44 (S101).

Next, correction coefficients are set to initial values, that is, a pulse width T=0 and a height H=0, for example (S102). By setting initial settings in this way, a so-called through setting is set in the filter 42 so as not to function. In such a state, a test signal is generated by the test signal generation unit 44, and emitted from the loudspeakers (S103). The test signal at this time is for measuring the standing wave state of the listening room, and the test signal at the listening point is acquired by the microphone 13 using the above-mentioned MLS signal and sweep signal (S104) (first acquisition). The recorded data is converted into frequency domain data using FFT, Hadamard transform, or the like (S105).

From the frequency characteristics of the obtained frequency domain data, peak positions and dip positions due to a standing wave are determined (S106). Among the determined peak positions and dip positions, if a dip or the like that exceeds a predetermined level is detected, that point is stored as a correction candidate. In S107, it is judged whether or not a correction candidate is present based on this result. Since it is not particularly necessary to perform correction or the like in the case where a correction candidate is not found, the processing may directly end (S115). If a correction candidate is found, a burst signal having a frequency serving as a correction target is output from the test signal generation unit 44 in S108.

The burst signal that has been output is emitted in the listening room from the output unit 43 and the loudspeakers 12, and is acquired having characteristics of the listening room by the microphone 13 (second acquisition). A/D conversion is performed on the acquired signal by the A/D converter 45, and thereafter the resultant signal is stored in the storage unit 50 via the arithmetic control unit 46 (S109).

Next, reverberation characteristics of the room are analyzed based on the recorded data (S110). Here, particularly, the increment ΔP of the signal acquired in S109 is calculated, where ΔP indicates an amount of increase of the peak in the trailing edge portion corresponding to the end position of the above burst signal relative to the peak of the portion corresponding to the stationary portion of the above burst signal. In the first loop, since both the correction coefficients T and H are not set, characteristics as they are will be measured, and in most cases, the characteristics that are measured exceed a predetermined value in ΔP threshold decision in S111. As previously described, the threshold value at this time may be set to a value equal to that of the portion in which the level has dropped due to interference or a value that is larger to an allowable extent relative to the dropped level, and may be decided as appropriate depending on the system.

If ΔP is not less than or equal to the predetermined value in S111, the correction coefficients T and H are set in S112. Since the values of T and H are thereby set, the filter 42 substantially operates as a filter. At this time, based on the value of T, the delay time ΔT is also set in the delay circuit 71.

Next, the processing returns to S108, where the burst signal is emitted again in the state where the correction coefficients are set. This is recorded (S109), and reverberation characteristics are analyzed (S110). Since the effect of the filter 42 is exerted on data recorded this time, data in which the reverberation characteristic portion has been attenuated is recorded. If ΔP of the reverberation characteristic portion has decreased below the predetermined value at this time, the correction coefficients at this time are adopted.

If ΔP is a value greater than the predetermined value, the values of the correction coefficients are increased, the same loop is repeated, and the correction coefficients that make the value of ΔP less than or equal to the predetermined value are decided. If it is judged that ΔP is less than or equal to the predetermined value, the values of T and H serving as correction coefficients and the value of ΔT are stored in S113. If there are a plurality of frequencies that are to be corrected, the same processing from S108 onward for deciding correction coefficients is repeated, and the processing ends when correction coefficients for all the peaks or dips have been decided (S115).

When correction coefficients are decided, the input switching unit 41 is switched so as to allow an ordinary input to pass through, and ordinary operation is performed, thereby enabling content that has been corrected by the filter 42 using the decided correction coefficients to be heard. At this time, an instruction to remove the microphone, for instance, may be given to the user via the display unit 14.

Depending on the system, it is possible to adopt the configuration in which H is fixed, and control is performed using only the pulse width T. Further, in the case where the pulse width T is not decided by measurement, but rather based on a table or the like, the attenuation with respect to the assumed reverberation is defined and stored in the table in advance, and the value is decided based on the reverberation characteristics of a test signal, for instance. In this case, it is possible to constitute a system in which the time period required for processing is reduced by adopting a configuration in which a coefficient is decided without performing the repeat loop from S111.

Figure 3:
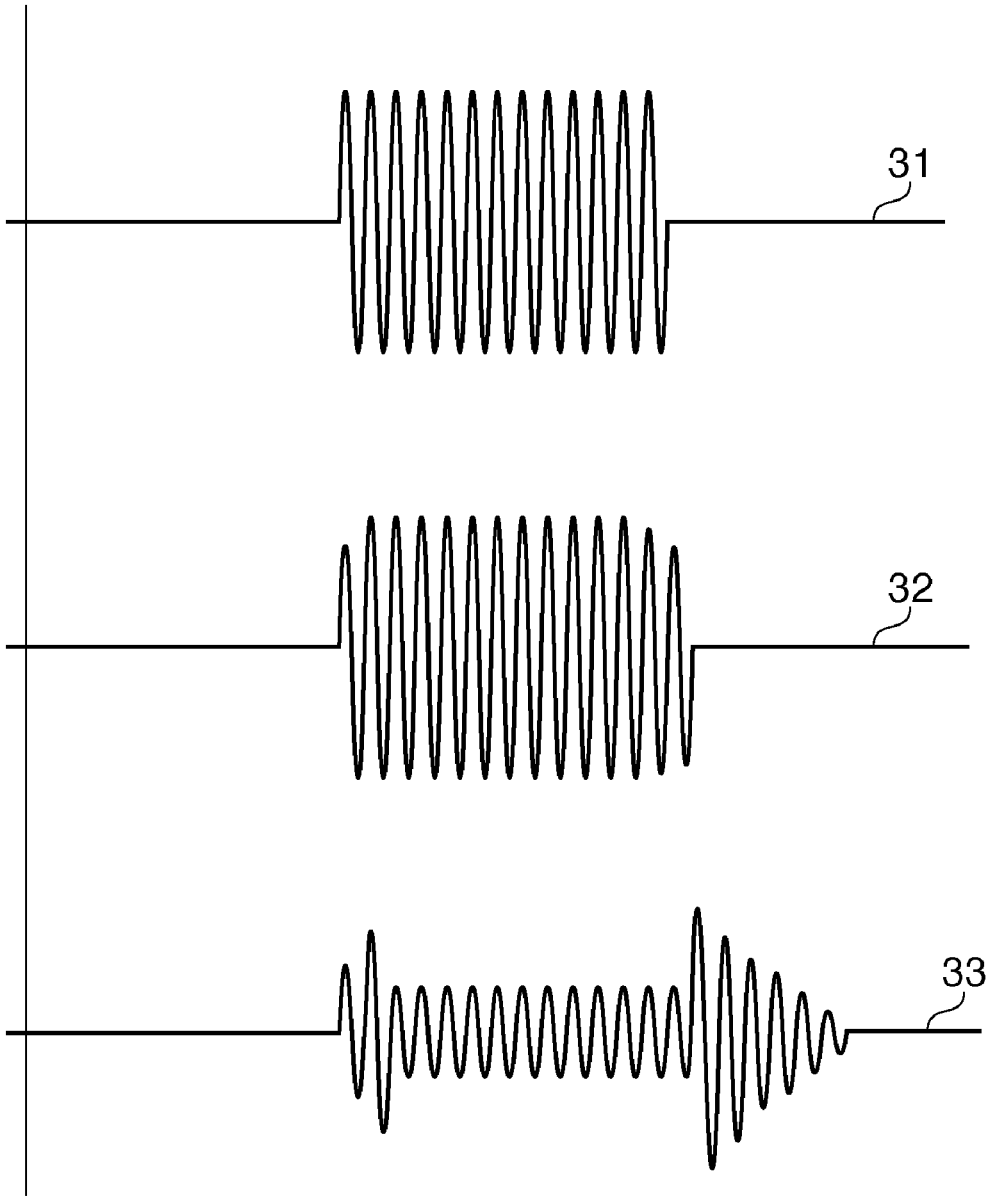
FIG. 3 is a diagram illustrating the influence of a standing wave.

In the embodiment described above, the configuration is adopted in which correction is performed in all cases. However, when the dip portion rises, original signal leading edge characteristics are obtained before resonance occurs as shown in FIG. 3. If this signal is eliminated by correction, this frequency signal may not be heard, and characteristics may deteriorate.

In view of this, it is sufficient to configure the system such that a frequency serving as a correction target is corrected only after a predetermined time period elapses. Specifically, a configuration is adopted in which operation of the filter starts after the predetermined time period elapses after a sound signal serving as an output target is input. It is sufficient to decide the predetermined time period for deciding whether or not to perform correction based on a leading edge time period Tr shown in FIG. 8. Since Tr is a time period until interference starts, correction is allowed to be performed in the case where a signal having the same frequency continues for a time period longer than or equal to Tr.

Here, a configuration may be adopted in which a signal from the differential circuit 75 in FIG. 4 is transmitted to the control signal generating circuit 76 so as to perform correction only in the case where a time Td between a positive side portion and a negative side portion of the differential signal 63 shown in FIG. 6 is Tr or longer.

Figure 10:
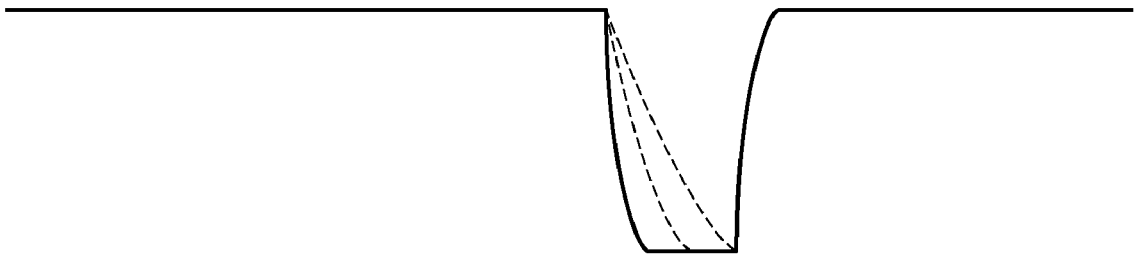
FIG. 10 is a diagram showing another example of an attenuation control signal.

A signal for correction is not limited to a pulse signal as shown by the attenuation control signal 53 in FIG. 5. It is also possible to apply a method for making trailing edge and leading edge characteristics of a pulse less steep as shown in FIG. 10, for example. Thus, by smoothly changing attenuation performed by the filter, an interfering state can be caused to gradually end, and a trouble concerning auditory sensation due to a rapid change can be reduced.

Although a standing wave dip frequency has mainly been described above, since tailing due to resonance also occurs in a peak portion as a matter of course, the same processing is applicable thereto. Further, although description with reference to the drawings is given assuming one frequency, it is of course possible to perform correction with respect to a plurality of dips and peaks using the same configuration.

Further, although the configuration has been described assuming that each block is constituted from a circuit, it is also possible to perform processing with software using LSI for sound processing such as a digital signal processor (DSP).

Other Embodiments

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-286961, filed Dec. 17, 2009, which is hereby incorporated by reference herein in its entirety.

What is claimed is:

1. A sound processing apparatus for adjusting a sound signal to be output based on acoustic characteristics of a listening room, the apparatus comprising:

a first acquisition unit configured to emit a test signal for measuring a standing wave state in the listening room from a loudspeaker, and acquire the test signal that has been emitted using a microphone;

a determination unit configured to determine a peak position or a dip position due to a standing wave based on frequency characteristics of the signal acquired by the first acquisition unit;

a second acquisition unit configured to emit a burst signal corresponding to a frequency of the peak position or the dip position from the loudspeaker in the listening room, and acquire the burst signal that has been emitted using the microphone;

a calculation unit configured to calculate an increment ΔP of the signal acquired by the second acquisition unit, the ΔP indicating an amount of increase of a peak in a trailing edge portion corresponding to an end position of the burst signal relative to a peak in a portion corresponding to a stationary portion of the burst signal; and a filter unit configured to attenuate a frequency component of the peak position or the dip position of the sound signal to be output by an attenuation depending on the ΔP.

2. The sound processing apparatus according to claim 1, wherein the filter unit includes:

a band pass filter configured to discriminate a frequency of the peak position or the dip position of the sound signal to be output;

an envelope generation unit configured to generate an envelope signal of an output signal of the band pass filter;

a differential unit configured to perform differential processing on the envelope signal, and obtain a differential signal;

a generation unit configured to generate an attenuation control signal having a time width and an amplitude depending on the ΔP at a position in synchronization with a signal on a negative side of the differential signal;

a delay unit configured to delay the sound signal to be output by a fixed time; and a notch filter configured to attenuate, by an attenuation instructed using the attenuation control signal, the frequency component of the peak position or the dip position of the sound signal that has been delayed by the fixed time by the delay unit.

3. The sound processing apparatus according to claim 2, wherein the generation unit measures a time period from when the peak has increased by the ΔP in the trailing edge portion until when the peak has decreased so as to have a value equal to a value of the peak in the stationary portion, and generates an attenuation control signal having a predetermined time width and a predetermined amplitude corresponding to the measured time period.

4. The sound processing apparatus according to claim 1, wherein the processing performed by the second acquisition unit, the calculation unit, and the filter unit is repeated until the ΔP becomes a predetermined value or less.

5. The sound processing apparatus according to claim 1, wherein the filter unit starts operation after a predetermined time elapses after the sound signal to be output is input.

6. A sound processing method executed by a sound processing apparatus for adjusting a sound signal to be output based on acoustic characteristics of a listening room, the method comprising:

a first acquisition step of emitting a test signal for measuring a standing wave state in the listening room from a loudspeaker, and acquiring the test signal that has been emitted using a microphone;

a determination step of determining a peak position or a dip position due to a standing wave based on frequency characteristics of the signal acquired in the first acquisition step;

a second acquisition step of emitting a burst signal corresponding to a frequency of the peak position or the dip position from the loudspeaker in the listening room, and acquiring the burst signal that has been emitted using the microphone;

a calculation step of calculating an increment ΔP of the signal acquired in the second acquisition step, the ΔP indicating an amount of increase of a peak in a trailing edge portion corresponding to an end position of the burst signal relative to a peak in a portion corresponding to a stationary portion of the burst signal; and a filter step of attenuating a frequency component of the peak position or the dip position of the sound signal to be output by an attenuation depending on the ΔP.

7. A non-transitory computer-readable storage medium storing therein a program that causes a computer to function as the units that the sound processing apparatus according to claim 1 comprises.

* * * * *